United States Patent [19]

DuCorday

[11] Patent Number: 4,800,110

[45] Date of Patent: Jan. 24, 1989

[54] HOT MELT GLUE BINDER

[76] Inventor: Gerard M. DuCorday, 10871 Thorley Rd., Santa Ann, Calif. 92705

[21] Appl. No.: 69,772

[22] Filed: Jul. 6, 1987

[51] Int. Cl.[4] ..... B42D 3/00; B42C 3/00

[52] U.S. Cl. ..... 428/43; 428/40; 428/194; 428/347; 412/6; 412/8; 412/900; 281/21 R; 281/34

[58] Field of Search ..... 428/40, 55, 122, 194, 428/43, 347; 281/21 R, 34, 29; 412/6, 8, 37, 900

[56] References Cited

U.S. PATENT DOCUMENTS

| | | | |
|---|---|---|---|
| 140,275 | 6/1873 | Jocelyn . | |
| 2,970,687 | 2/1961 | Johnson | 206/62 |
| 3,133,750 | 5/1964 | Gerald | 281/34 |
| 3,278,504 | 10/1966 | Eells et al. | 260/88.2 |
| 3,437,506 | 4/1969 | Falberg | 117/44 |
| 3,531,358 | 9/1970 | Rost et al. | 156/475 |
| 3,572,767 | 3/1971 | Learned | 281/34 |
| 3,788,921 | 1/1974 | Polit et al. | 156/216 |
| 3,840,254 | 10/1974 | Shatzkin | 281/21 |
| 3,847,718 | 11/1974 | Watson | 161/39 |
| 3,891,240 | 6/1975 | DuCorday | 281/29 |
| 3,973,787 | 8/1976 | Staats et al. | 281/21 |
| 4,129,471 | 12/1978 | Rome | 281/21 R X |
| 4,355,822 | 10/1982 | McHugh | 281/34 |
| 4,371,194 | 2/1983 | Wang et al. | 281/21 R |
| 4,371,195 | 2/1983 | Wang et al. | 281/21 |
| 4,385,225 | 5/1983 | Giulie | 219/521 |
| 4,471,976 | 9/1984 | Giulie | 412/6 X |
| 4,496,617 | 1/1985 | Parker | 428/55 |
| 4,673,324 | 6/1987 | Hanson et al. | 412/8 X |

*Primary Examiner*—Alexander S. Thomas
*Attorney, Agent, or Firm*—Gausewitz, Carr & Rothenberg

[57] ABSTRACT

A binder strip for home or office use in binding document pages includes a binder sheet having a full back cover section and a narrow front cover attaching flange section with a spine section interposed between the two. The spine section is provided with a number of closely adjacent beads of hot melt glue and the attaching flange section has a strip of peel-off pressure sensitive adhesive affixed to a free edge thereof. A front cover for the binder is totally separate from the binder and initially may not even be a part of the binder. The front cover is processed by any suitable home or office copier, embossing, foil stamping, color printing or like machine capable of custom processing a single sheet of ordinary document size. The processed cover is then attached to the attaching flange by means of the pressure sensitive adhesive. Document pages are stacked and inserted against the glue strips of the spine, and the glue is heated to secure the document pages and provides a complete bound document having the selectively processed front cover.

23 Claims, 2 Drawing Sheets

FIG. 3.
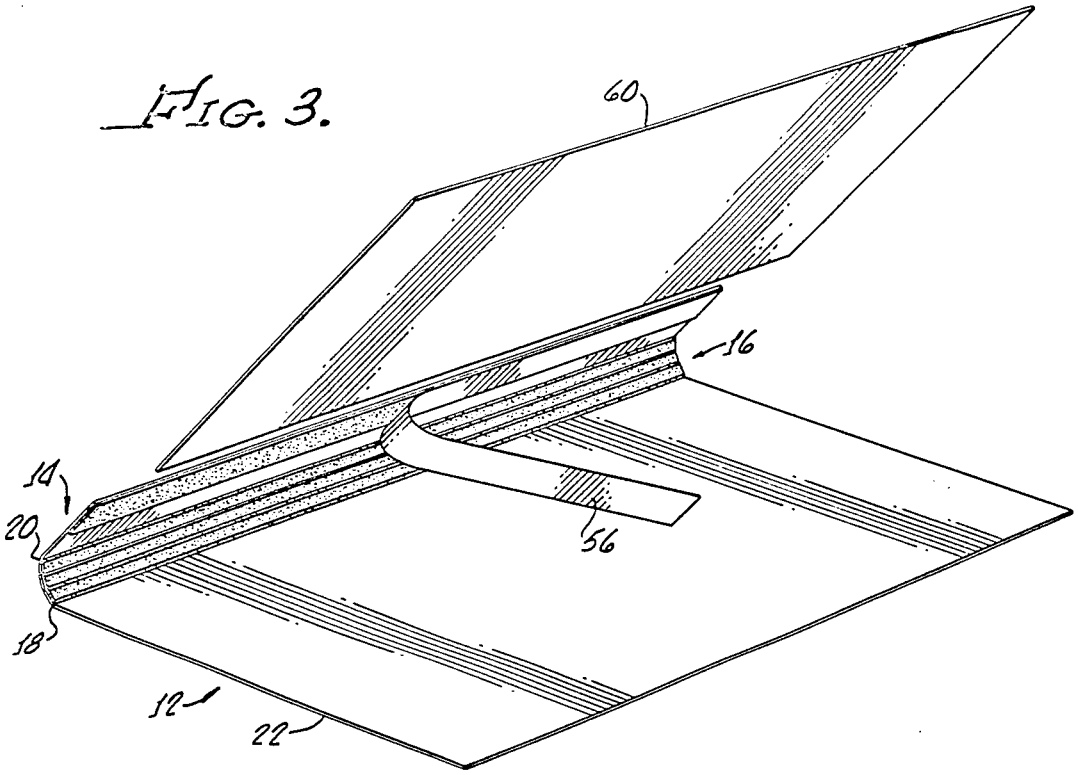
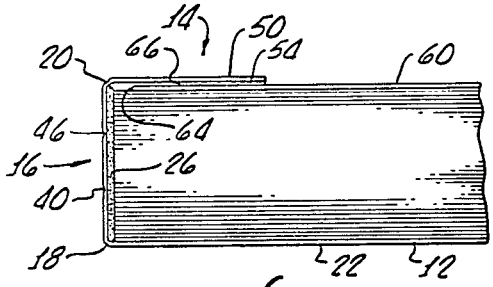
FIG. 4.
FIG. 5.
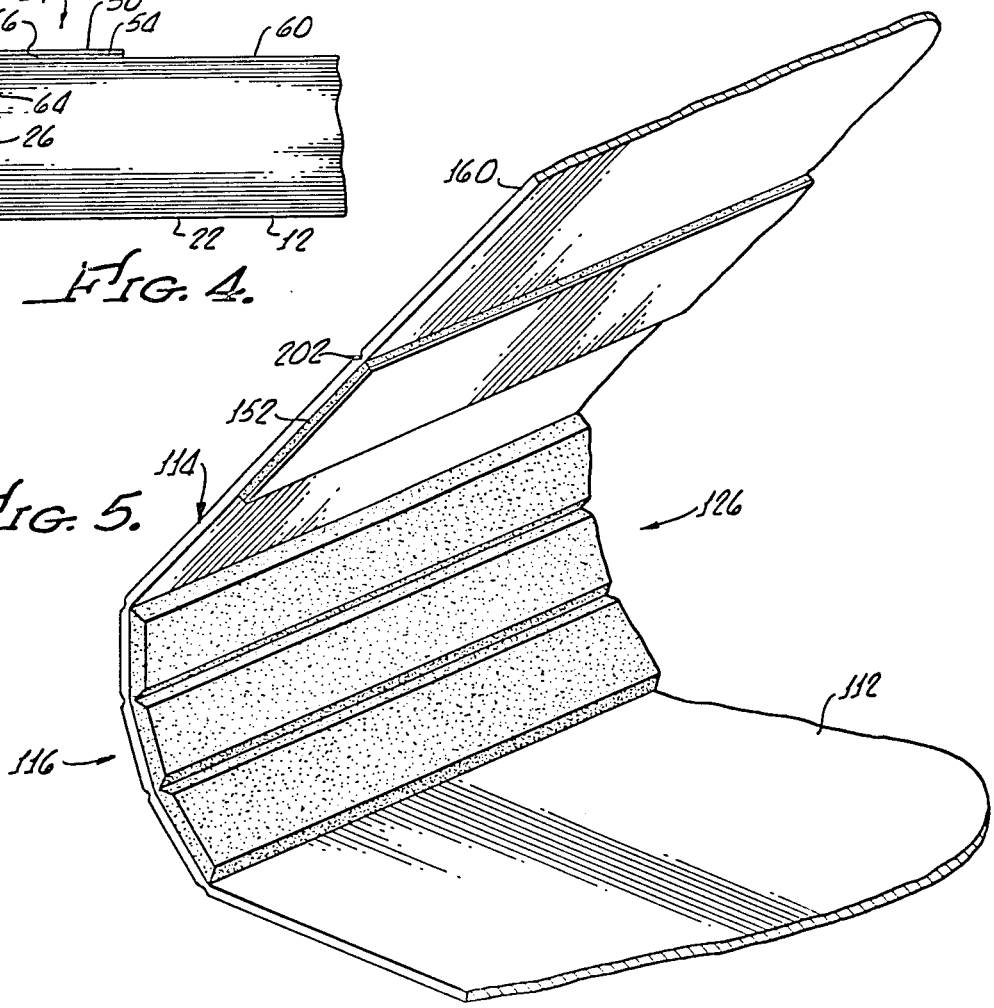

HOT MELT GLUE BINDER

BACKGROUND OF THE INVENTION

The present invention relates to hot melt glue binding, and more particularly concerns such binding which offers maximum adaptability and flexibility in home or office preparation of the front cover and thickness of bound documents.

Presently known glue binders for home or office use generally employ pre-formed front and back covers having a spine or backbone bearing hot melt glue, or provide only a glue bearing spine strip. Typical of such binders are the arrangements illustrated in U.S. Pat. Nos. 4,371,194 to Wang, et al, 4,471,976 to Giulie, 4,129,471 to Rome, and 4,496,617 to Parker. The Parker patent employs only a backbone strip having bands of hot melt glue adapted to cover and connect to the back edges of the sheets to be bound and also has hot melt glue bands that are adapted to be secured to the topmost and bottommost sheets of the stack, which then serve as front and back cover sheets of the bound volume. The arrangements of the Wang et al, Giulie and Rome patents, on the other hand, provide binders having complete front and back covers which form the outer covers of the completed bound document. Of these, the patent to Wang et al provides for variable thickness of bound documents by providing a variable width foldable spine. If the spine is folded to accept a smaller stack of documents, one of the covers inherently becomes wider, and thus Wang et al must provide for folding of a cover end remote from the spine, to eliminate this increase in cover width and to obtain a more regular finished document.

A major drawback of the arrangements of Rome, Wang et al and Giulie is that the cover sheets are an integral part of the binder, and there is thus little flexibility in choice of cover or in ability to process the cover. The patent to Parker addresses this problem by providing no covers for the binder but rather arranging the spine with several spaced bands of precisely configured and positioned hot melt glue so that a central glue band will adhere to and bind back edges of the document, and two additional side glue bands on either side of the central band will simultaneously adhere to the top and bottom sheets of the stack of documents being bound. The glue is conventional hot melt adhesive, and thus the entire stack, including the top and bottom sheets which form front and back covers, must be bound together, all at the same time. A more significant problem with the arrangement of Parker, which is discussed at length in the patent itself, is the difficulty of ensuring that the binder strip, or substrate, which carries the hot melt glue will adequately and properly adhere to the top and bottom sheets. The Parker binder requires precision manufacturing with small tolerances of glue strip thicknesses and gaps, and moreover, after manufacturing can fit only one thickness of document which must be precisely matched to the size of the Parker binder strip. In the arrangement of Parker, in order to ensure proper adhesion of the binder strip to the cover, it is essential to carefully control the location and thickness of the glue bands and the gaps between the various glue bands. Failure to meet these precise requirements results in a poor and unacceptable binding. Moreover, the Parker system requires a special, complex and costly machine capable of heating and pressing the spine and both sides of the binder. Thus Parker is not really an in-home or office system.

Accordingly, it is an object of the present invention to provide a hot melt glue binder for home or office use that avoids or minimizes above-mentioned problems.

SUMMARY OF THE INVENTION

In carrying out principles of the present invention, in accordance with a preferred embodiment thereof, a binder sheet is formed having a back cover, a spine and a front cover attaching flange. Hot melt adhesive is applied to the spine section, and a separate peel-off pressure sensitive adhesive strip is applied to an edge of the front cover attaching flange. Pages of a document to be bound, excepting only the cover sheet of the bound document, are stacked and pressed against the hot melt adhesive, which, when heated, secures the document sheets to one another and to the binder. A front cover is then separately processed, as a separate individual sheet, to provide appropriate printing, embossing or other ornamentation or indicia thereon and then individually attached to the front cover attaching flange by means of the pressure sensitive adhesive. No further heating is required for attachment of the front cover, and, moreover, the latter may be readily detached and replaced with another front cover, as the pressure sensitive adhesive may be reusable. The hot melt adhesive of the spine is laid down in contiguous glue beads, one or more of which may be separately removed to enable the spine to be folded to a lesser width so as to accommodate a document stack of fewer sheets.

BRIEF DESCRIPTION OF THE DRAWINGS

FIG. 3 shows the binder strip with a front cover about to be attached thereto;

FIG. 4 is an elevation view of a completed bound document; and

FIG. 5 shows a modification of the binder sheet of FIGS. 1 through 4.

DETAILED DESCRIPTION

Figure 1:
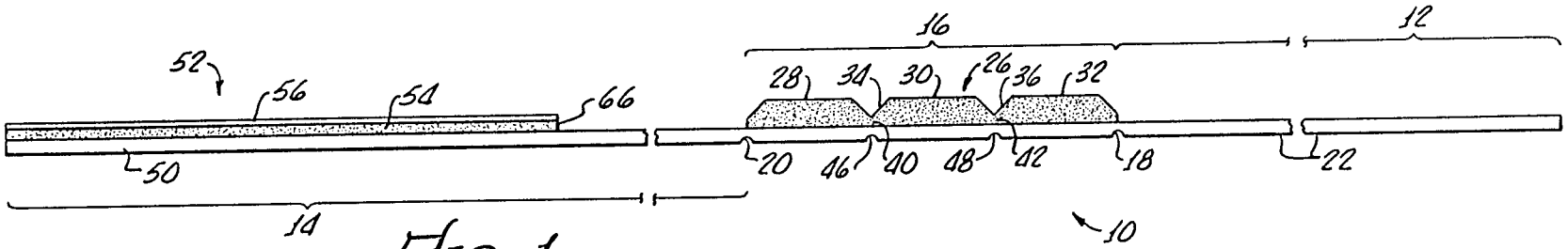
FIG. 1 shows an edge view of an unfolded binder sheet embodying principles of the present invention.

As shown in FIG. 1, a binder embodying principles of the present invention, in one embodiment thereof, is made of a substantially rectangular binder sheet 10 formed of a suitably strong material, such as heavy paper, cardboard of appropriate thickness and stiffness, vinyl or like material and includes a back cover section 12, a front cover attaching flange section 14, and an intermediate spine section 16 between sections 12 and 14, all being integral with one another. The spine section is defined in part and separated from the other sections by fold lines in the form of V-shaped grooves 18,20 extending the full height and formed in an outer surface 22 of the sheet 10. The inner surface of the sheet 10, for almost the full width of the spine section 16, and for substantially the entire length thereof has secured thereto a strip of temperature sensitive adhesive in the form of a strip of hot melt glue 26.

Preferably the strip of hot melt glue 26 includes a plurality of immediately contiguous, side-by-side glue beads 28,30,32 separated from one another by V-shaped grooves 34,36. The grooves 34,36 do not extend completely through the glue strip 26, but stop short of the inner surface thereof, which is affixed to spine section 16, to provide very thin, longitudinally extending continuous connecting sections or strips 40,42 between mutually adjacent ones of the individual glue beads. The arrangement is such that individual ones of the glue beads 28,30,32 may be separately removed from the spine and detached from the adjacent glue beads merely by prying up one end of a bead and peeling it from the spine section 16 in an action which severs the very thin connecting sections 40 or 42. In this manner, and for reasons to be described below, the spine can be provided with a glue strip having a smaller number of glue beads, less than the number of such beads originally adhered to the spine, and therefore of less total width. The spine section is also provided on its outer surface 22 with additional V-shaped grooves 46,48 extending partly into the spine, each positioned opposite a corresponding glue strip groove 34,36, respectively.

Front cover attaching flange section 14 is of relatively small width and may be three or four times the width of the spine, but as little as one-fifth or less of the width of the back cover 12. The back cover has a width and length substantially the same as the width and length of sheets to be bound, such as, for example, 8½ inches×11 inches, but may have a width and length slightly greater than the conventionally sized 8½×11 sheet to provide a slight extension of the back cover beyond the free edge of pages to be bound.

Securely affixed to the end portion 50 of front cover attaching flange 14 and running for the full length thereof is a strip of peel-off, pressure sensitive adhesive 52, including a strip of adhesive 54 and a protective or peel-off sheet 56. In a presently preferred embodiment the inner end of adhesive strip 52 is spaced from groove 20 by a substantial distance, but less than the width of the spine. This allows for adjustment of front cover width as will be explained below.

The hot melt glue strip 26 is temperature sensitive, of the type well known to those skilled in the art that is very low tack at room temperature. When subjected to increased temperature the hot melt glue strip will soften or melt, and, upon subsequent cooling, secure itself to articles such as edges of document sheets that have been pressed against the glue strip while it is heated. Thus, at room temperature the hot melt glue is relatively rigid, provides good securement, and has little tendency to attach itself to articles or materials not already secured thereto. The pressure sensitive adhesive 52, on the other hand, has a high tack at room temperature and does not operate in response to temperature variations, nor does it require heat for its operation. The pressure sensitive adhesive 54 is provided, as is well known, with a non-stick protective or peel-off cover 56 which prevents the adhesive 54 from attaching itself to objects or articles until the peel-off cover 56 is removed. After removal of the peel-off cover 56, pressing of an object, article or document cover upon the pressure sensitive adhesive will secure the article or cover to the adhesive firmly and securely. Further, as an additional feature of the pressure sensitive adhesive, articles secured thereto by pressure may, with careful manipulation, be detached and reattached or detached and replaced by similar articles, all without addition or application of heat.

Figure 2:
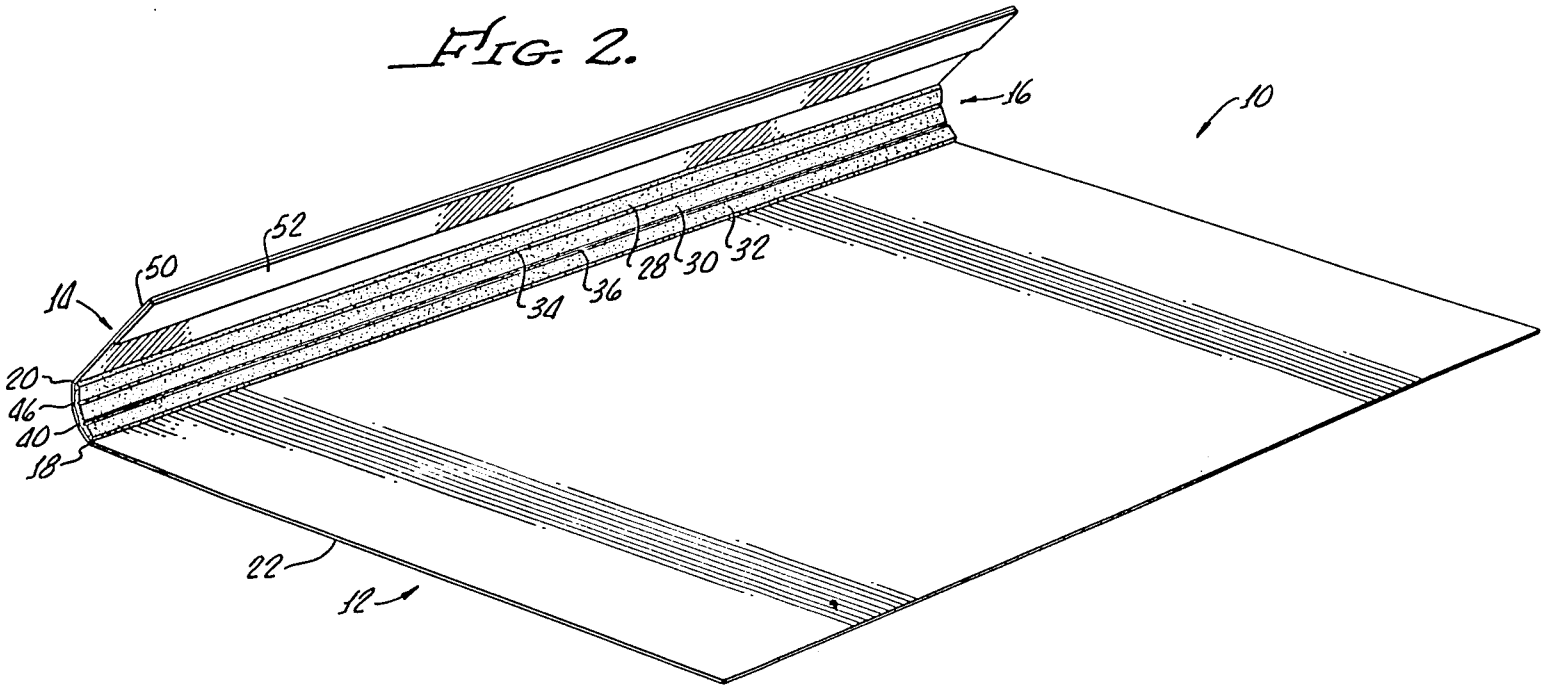
FIG. 2 is a pictorial illustration of the binder sheet of FIG. 1, partly folded to enable it to accept a stack of document sheets.

In use of the described binder, a binder sheet formed as described above and illustrated in FIG. 1 is partly bent or folded, in the manner shown in FIG. 2, with the spine section 16 being folded relative to the back cover section 12 about score line or V-shaped groove 18, and the front cover attaching flange section 14 being folded relative to the spine about the score line or V-shaped groove 20. This positions both the hot melt glue strip 26 and the pressure sensitive peel-off adhesive strip, with the protective cover 56 still attached, on the inside of the partly folded binder. Now a stack of document pages generally of a size substantially equal to or just smaller than the size of back cover section 12 is inserted into the binder between the back cover section 12 and flange section 14 with all of the edges of the stack of document sheets firmly abutting the glue strip 26. The outside of the spine section 16 is then heated by any suitable means, including conventional well known hot melt glue heaters. When the heat is removed, the document sheets are all secured at their rearmost edges to one another and to the spine 16 by means of the melted and then re-hardened temperature sensitive adhesive strip 26. At this stage of assembly neither the front nor back sheets of the stack of documents is secured directly to either the back cover section 12 or to the front cover attaching flange section 14. Now a suitable cover sheet 60 may be selected, processed as desired, on any small in-home or office equipment, and then attached to the front cover attaching flange section 14. This is done merely by peeling off the protective strip 56 to expose the surface of pressure sensitive adhesive 54 and pressing an edge portion of the independently and separately processed cover sheet 60 against the pressure sensitive adhesive to securely affix front cover 60 to flange 14, and thus to the previously bound document. It will be readily appreciated, of course, that the order of attachment of cover sheet and document sheets may be reversed so that the front cover sheet 60 may be first attached to the flange 14 by means of the pressure sensitive adhesive and then the document pages may be inserted in the binder and attached to the spine by means of heating and then cooling of the temperature sensitive glue strip 26. In either case the front cover sheet can be separately and independently processed for attachment to the binder.

It is important to emphasize that the front cover is but a single sheet of approximately document size, which may be in the order of or slightly larger than 8½ inches×11 inches, for example, and may be readily processed as such as a separate single sheet in any suitable manner and by any one of the many types of equipment commonly available in home or office.

There is presently widely available a variety of inexpensive so called desk-top publishing equipment for use in home or office, as distinguished from a factory type environment, which is revolutionizing printing and pre-production capabilities of large and small businesses, leading to profound changes in office practices everywhere. High volume generic product service and sales literature print jobs are being replaced by numerous customized small job productions aimed at specific groups and clients, promising a more effective flow of pertinent information, and resulting in substantial economies and improved market efficiencies. Such in-office or in-home publishing equipment includes desk-top computer driven printers, enlarging and reducing color copiers, small laminators, foil applying, stamping and embossing machines. Although such in-office equipment or in-home equipment provide a variety of different types of processing to provide a variety of different types of indicia on a sheet of paper of a single front cover, there is one major limitation that is common to many different types of this equipment. This limitation is the fact that the machines can handle only a single sheet of paper of conventional size and are not capable of handling a full size binder, such as would normally include both front and back covers and an interconnecting document spine. Thus presently available in-office or in-home publishing equipment can be readily, efficiently and inexpensively applied for manufacture of customized documents, even in small quantities, provided only that the binding arrangement permits use of a front cover that can be processed separately, apart from the remainder of the binder.

According to an important feature of the present invention, the front cover need not be attached to the binder at the same time that the document pages are attached to the binder, and, moreover, can be later detached from the binder and replaced, since the pressure sensitive adhesive for attaching the front cover can be reused. Thus a number of documents may be prepared, completely bound excepting only for lack of a front cover, stacked, stored, handled or transported to remote locations and then individual cover sheets may be applied to different ones or different groups of such pre-formed and prebound documents at the same or remote locations, or at different times, as deemed necessary or appropriate. The entire document can be prepared in large quantities, and selection of one cover or different types of covers for different groups of the pre-prepared documents may be made at a later time or at a different location. Further, having completely bound a document and attached a given cover, the latter may be changed simply by detaching the first cover from the pressure sensitive adhesive, processing a substitute cover as desired, and then attaching the substitute cover to the same strip of pressure sensitive adhesive.

As previously mentioned, the temperature sensitive glue strip 26 is formed into separate but continuously longitudinally interconnected beads, each of which can be individually removed from the spine 16 and detached from an adjacent bead along the very thin relatively weak connecting portions 40 or 42. Moreover, the spine is additionally scored, as at 46 and 48, at points directly opposite the respective glue strip scores 34,36. Thus the spine 16 may be made with a width capable of accommodating a relatively large number of sheets, and, when such a large number of sheets is bound and the binding completed, the completed document will appears as illustrated in the elevational view of FIG. 4, wherein the flange 14 is folded relative to spine 16 about the fold or score line 20, and back cover 12 is folded relative to the spine about the score line 18.

The described arrangement, even though capable of use with a thick document, will readily accommodate efficient binding of a thinner document merely by removing one of the endmost glue beads, such as glue bead 28, for example, and then folding the flange 14 relative to the spine 16 about the intermediate spine score line 46, rather than score line 20. Removal of the glue bead 28 significantly facilitates folding of the binder about the intermediate score line 46. Without such removal of the endmost glue bead, folding of the spine about the intermediate score line 46 would be difficult, and, at best, would result in a dislocation of the corner of the bound document at this point.

It will be readily appreciated that the spine may be made with two, three, four or more individual beads of temperature sensitive adhesive, all mutually continuous along their inner surfaces, but all provided with separable score lines or V-shaped grooves such as those indicated at 34 and 36 in FIG. 1. Thus, in manufacture of the described binder, a single size may be produced and will readily fit a final bound document of any one of many different thicknesses.

Where one or more of the glue beads is removed for binding of a document of fewer sheets, the effective width of flange 14 is increased by the total width of the glue beads that have been removed, with the spine now being bent along one of the intermediate spine grooves, such as groove 46 or 48. The additional effective width of the front cover attaching flange is readily accommodated, without change of front cover sheet width, merely by changing the relative position of the innermost end of the front cover sheet with respect to the spine. As can be seen in FIG. 4, the innermost edge 64 of the front cover projects inwardly of the inner edge 66 of the peel off adhesive strip 54. The amount of this projection is readily varied during attachment of the cover sheet to the flange. The same size front cover sheet is readily employed with documents of different thicknesses. As previously indicated, a different width of cover sheet required by different spine width for variation of documents of different thicknesses is accomplished by the amount by which the front cover attaching flange 14 overlaps the inner edge 64 of the front cover. It is not required, with such an arrangement, to either cut or fold the free edge of the front cover. Thus the free edge of the front cover can be positioned relative to the free edge of the back cover or the free edges of the bound document pages in the same relation regardless of the thickness of the document and without changing front cover width. Variation of the effective width of the flange is accommodated merely by varying the degree of overlap between the flange and the inner edge portion of the front cover.

If deemed necessary or desirable, the front cover can be manufactured as an integral part of the binder, as illustrated in FIG. 5. A binder sheet having a front cover attaching flange 114 and pressure sensitive adhesive strip 152 connected to a spine section 116 and a full width back cover section 112, are all substantially the same as described in connection with the embodiment illustrated in FIGS. 1 through 4. In the embodiment of FIG. 5, however, an integral front cover sheet 160 is provided. Front cover 160 is formed integrally with the front cover attaching flange section 114 and separated therefrom by a score line 202 in the form of a V-shaped groove or line of perforations (not shown) or the like that facilitates ready separation of front cover sheet 160 from the flange 114. Separation line 202 is formed at the forward or free edge of adhesive strip 152 and extends for the full length of the binder sheet, from the top of the sheet to the bottom of the sheet, to enable ready and complete separation of the cover sheet 160 from the rest of the binder.

In use of the arrangement of FIG. 5, the totally preformed binder sheet is manufactured with the integrally attached but readily separable front cover sheet. For binding of a document the front cover sheet 160 is removed by separating it from the flange 114 along the separation line 202, and then the document is assembled and bound by hot melt glue strip 126 just as described in connection with the embodiment of FIGS. 1 through 4. The front cover sheet 160, after separation from the remainder of the binder, may be separately and individually processed to provide front cover indicia by any suitable processing means, including various in-office or in-home desk top publishing devices, copiers, embossers, laminators or foil application machines as appropriate. After processing of the separated front cover 160, it is then re-attached to the flange 114 by means of the pressure sensitive adhesive 152. An advantage of this arrangement is the fact that a front cover sheet of appropriate material, rigidity, and consistency is readily available at all times with the binder. Moreover, the user has the option of using the front cover sheet that is provided with the binder or merely detaching this integral front cover sheet 160 and discarding it to be replaced by some other sheet at the desire of the user. Preferably the width of the front cover sheet is sufficiently great to accommodate the necessary amount of overlap of the inner edge of the front cover with the front cover attaching flange as previously described. The effective width of this front cover sheet is varied for bound documents of different thicknesses by adjusting the amount of overlap between the front cover and the pressure sensitive adhesive strip.

There have been described binding apparatus and techniques for preparing customized documents which are specifically and readily adaptable for use of in-home or in-office single sheet processing machines to provide bound documents with individually customized and replaceable front covers and which, moreover, are readily adapted to the binding of documents of a variety of different thicknesses.

The foregoing detailed description is to be clearly understood as given by way of illustration and example only, the spirit and scope of this invention being limited solely by the appended claims.

What is claimed:

1. A method of binding and securing a protective cover to a group of document pages comprising the steps of:

forming a binder and rear protective cover having a back cover section, a spine section, and a narrow front cover attaching flange section, said spine section being interposed between said flange section and back cover section, defining first and second fold lines respectively between said spine section and said back cover section and between said spine section and said flange section, securing a strip of pressure sensitive adhesive to a free edge of said narrow flange section with an inner edge of said adhesive at a distance from said second fold line, securing a strip of temperature sensitive adhesive to said spine section, inserting a plurality of document pages between said flange section and back cover section and abutting edges of said document pages against said temperature sensitive adhesive, folding said back cover and flange section relative to said spine section along said first and second fold lines, heating the spine section and the temperature sensitive adhesive secured thereto to melt the temperature sensitive adhesive and attach said document pages to the spine section, forming a separate front protective cover of a size substantially the same as said document pages, with separate cover indicia thereon, and pressing an edge portion of said separately formed front protective cover against the pressure sensitive adhesive strip of said narrow front cover attaching flange section to thereby separately and independently attach said front cover to the binder and rear protective cover at a position spaced from the spine section and the temperature sensitive adhesive thereon.

2. The method of claim 1 including the steps of removing said front cover from said binder and cover body without detaching said document pages from the spine section by separating the front cover from the strip of pressure sensitive adhesive and attaching a replacement front cover to the binder and cover body by pressing an edge portion of the replacement cover to the strip of pressure sensitive adhesive.

3. The method of claim 1 wherein said strip of temperature sensitive adhesive includes a plurality of mutually contiguous beads of hot melt glue, and including the steps of forming a third fold line in said spine section between first and second ones of said beads of glue, and removing one of said beads of glue from said spine section, said steps of folding said back cover section and flange section relative to said spine section comprising folding said spine section about said third fold line after removing said one bead of glue, thereby decreasing the width of said spine section.

4. The method of claim 3 wherein said step of folding said spine section about said fold line changes the position of said pressure sensitive adhesive strip relative to said spine section, and wherein said step of pressing an edge portion of said front cover sheet comprises the step of adjusting the position of said edge portion relative to said pressure sensitive adhesive strip to accommodate the change of position of the pressure sensitive adhesive strip.

5. The method of claim 3 wherein said third fold line comprises a longitudinally extending score line between adjacent ones of said beads of glue to facilitate folding of said spine along said third fold line after removal of said one bead of glue.

6. The method of claim 1 wherein said fold lines comprise score lines extending longitudinally of said binder and cover body to facilitate folding of the binder sections relative to one another.

7. The method of claim 1 wherein said step of forming a separate cover comprises separately passing said front cover through an indicia forming machine independently of said binder and cover body prior to pressing the front cover edge portion against the flange adhesive strip.

8. The method of claim 1 wherein said step of forming a separate front protective cover comprises forming said front cover of the same material as said binder and rear protective cover, and positioning the front protective cover with an inner edge thereof spaced from said spine section and from said temperature sensitive adhesive.

9. The method of claim 1 wherein said step of forming a binder and rear protective cover comprises forming the binder and rear protective cover of a document protecting suitably strong, cover material that forms a protective cover for bound document pages, and wherein said step of forming a separate front protective cover comprises forming said front protective cover of a suitably strong, protective material that forms a protective custom decoratable cover for the front portion of said document.

10. The method of claim 1 wherein said binder and rear protective cover is formed of a cover material of appropriate thickness and stiffness and wherein said front protective cover is formed of a cover material having the same thickness and stiffness as said binder and rear protective cover.

11. The method of claim 1 wherein said front protective cover is formed of cardboard.

12. The method of claim 1 wherein said front protective cover is formed of a heavy protective paper.

13. The method of claim 1 wherein said front protective cover is formed of a protective plastic material.

14. A method of binding a group of document pages comprising the steps of:

forming a binder sheet having a back cover section, a spine section, and a narrow front cover attaching flange section, said spine section being interposed between said flange section and back cover section, defining first and second fold lines between said spine section and said back cover section and between said spine section and said flange section, securing a strip of pressure sensitive adhesive to a free edge of said narrow flange section, securing a strip of temperature sensitive adhesive to said spine section, inserting a plurality of document pages between said flange section and back cover section and abutting edges of said document pages against said temperature sensitive adhesive, folding said back cover and flange section relative to said spine section along said first and second fold lines, heating the spine section and the temperature sensitive adhesive secured thereto to melt the temperature sensitive adhesive and attach said document pages to the spine section, forming a separate front cover sheet of a size substantially the same as said document pages, with separate cover sheet indicia thereon, and pressing an edge portion of said separately formed front cover sheet against the pressure sensitive adhesive strip of said narrow front cover attaching flange section to thereby separately and independently attach said front cover sheet to the binder sheet, said step of foming a binder sheet comprising forming the binder sheet with a full front cover sheet formed integrally with said flange section, forming a longitudinally extending front cover detaching line between the flange section and the full front cover sheet, and wherein said step of forming a separate front cover sheet comprises detaching said full front cover sheet from said flange section at said detaching line prior to forming cover sheet indicia on the front cover sheet.

15. The method of forming a binder comprising the steps of:

forming a sheet of binder material having an integarlly formed, back cover section, a front cover attaching flange section, and a spine section interposed between the flange section and back cover section, securing a strip of longitudinally extending pressure sensitive peel-off adhesive to an edge of said flange section remote from said spine section, securing to said spine section a plurality of mutually adjacent parallel beads of hot melt glue strips extending longitudinally along said spine section, and forming fold lines between the spine section and each of said back cover and flange sections said step of forming a sheet of binder material including forming a full and completely detachable front cover sheet integrally with said flange section and forming a separation line between the detachable front cover sheet and the flange section, whereby the front cover sheet may be readily separated from the flange section, processed separately to form front cover indicia thereon, and then reattached to the cover flange section by said pressure sensitive adhesive.

16. A binder for binding a plurality of document sheets comprising:

a sheet of binder material having a back cover section, a front cover attachment flange section, and a spine section connected to and interposed between said back cover section and flange section, a strip of hot melt glue affixed to said spine section and extending substantially the full length thereof, first and second fold lines formed on said binder material sheet defining lines of separation between said spine section and said back cover section and between said spine section and said flange section respectively, and a strip of peel-off pressure sensitive adhesive attached to an edge of said flange section and extending along the length thereof, said peel-off adhesive adapted to be secured to a separate front cover sheet that is separately processed to provide front cover indicia before attachment to the flange section, including a full size front cover sheet formed integrally with said front cover attachment flange section and a detachment score line formed in said binder sheet between said full size front cover sheet and said flange section for facilitating complete separation of the front cover sheet from said flange section, whereby said front cover sheet may be readily separated from said flange section, separately processed to provide covering indicia and then reattached to said flange section at said strip of pressure sensitive adhesive.

17. The method of forming a protective cover comprising the steps of:

forming a protective body of binder material having an integrally formed back cover section, a front cover attaching flange section, and a spine section interposed between the flange section and back cover section, securing a strip of longitudinally extending pressure sensitive peel-off adhesive to an edge of said flange section remote from said spine section and at a position spaced from said spine section, securing to said spine section a plurality of mutually adjacent parallel beads of hot melt glue strips extending longitudinally along said spine section, and forming fold lines between the spine section and each of said back cover and flange sections, including the step of forming a protective front protective cover, and attaching said front protective cover to said peel-off adhesive with an innermost edge of said front protective cover spaced from said spine section.

18. A decorative protective cover and binder for binding and protecting a plurality of document sheets comprising:

a body of binder material having a back cover section, a front cover attachment flange section, and a spine section connected to and interposed between said back cover section and flange section, a strip of hot melt glue affixed to said spine section and extending substantially the full length thereof, first and second fold lines formed on said binder material defining lines of separation between said spine section and said back cover section and between said spine section and said flange section respectively, and a strip of peel-off pressure sensitive adhesive attached to an edge of said flange section and extending along the length thereof, said strip being spaced from the spine section, said peel-off adhesive adapted to be secured to a separate front protective cover that is separately processed to provide front cover indicia before attachment to the flange section, and a front cover sheet made of a protective material secured to said pressure sensitive adhesive and having an inner edge spaced from said spine section.

19. A combined binder and protective cover for binding and protecting a plurality of document sheets comprising:

a protective cover body having a back cover section, a front cover attachment flange section, and a spine section connected to and interposed between said back cover section and flange section, said body being formed of a protective binder material, a strip of hot melt glue affixed to said spine section and extending substantially the full length thereof, first and second fold lines formed on said body defining lines of separation between said spine section and said back cover section and between said spine section and said flange section respectively, a strip of peel-off pressure sensitive adhesive attached to an edge of said flange section and extending along the length thereof, and a separate front cover, detachably secured to the flange section and separately processed to provide front cover indicia or decoration before attachment to the flange section, said front cover being formed of a protective binder material having an inner edge secured to said pressure sensitive adhesive.

20. The binder and protective cover of claim 19 wherein said separate front cover is formed of cardboard.

21. The binder and protective cover of claim 19 wherein said separate front cover is made of a plastic material.

22. The binder and protective cover of claim 19 wherein said flange section has a width greater than the width of said spine section, wherein said strip of peel-off pressure sensitive adhesive has an innermost edge spaced from said spine section, and wherein said front protective cover has an innermost edge adjustably positioned between the innermost edge of said pressure sensitive adhesive and said spine section.

23. The binder and protective cover of claim 19 wherein said front protective cover is made of the same protective binder material as said back cover, front cover and spine sections.

* * * * *